United States Patent [19]

Young

[11] 4,005,746

[45] Feb. 1, 1977

[54] SECTIONAL HEAT EXCHANGER

[75] Inventor: Fred M. Young, Racine, Wis.

[73] Assignee: Young Radiator Company, Racine, Wis.

[22] Filed: Aug. 22, 1975

[21] Appl. No.: 606,887

[52] U.S. Cl. ..... 165/69; 165/82; 165/76

[51] Int. Cl.[2] ..... F28F 7/00

[58] Field of Search ..... 165/144, 5, 81–83, 165/166, 69, 149, 76; 113/118 R, 118 A, 118 B; 29/157.3

[56] References Cited

UNITED STATES PATENTS

| | | | |
|---|---|---|---|
| 1,813,221 | 7/1931 | Young | 165/144 |
| 2,308,119 | 1/1943 | Spieth | 165/83 |
| 2,599,965 | 6/1952 | Young | 113/118 B X |
| 3,255,816 | 6/1966 | Rosenblad | 165/166 |

*Primary Examiner*—Charles J. Myhre
*Assistant Examiner*—Theophil W. Streule, Jr.
*Attorney, Agent, or Firm*—Arthur J. Hansmann

[57] ABSTRACT

A sectional heat exchanger having a frame for receiving and supporting a plurality of heat exchanger units which have a yieldingly compressible plate attached to the side of the unit and extending in abutment with each other for snugly retaining the units within the frame.

5 Claims, 6 Drawing Figures

SECTIONAL HEAT EXCHANGER

This invention relates to a sectional heat exchanger of the type having a plurality of units which are supported within a frame.

BACKGROUND OF THE INVENTION

Sectional heat exchangers are already well known in the prior art, and one example of such is found in my U.S. Pat. No. 3,710,853. In these sectional heat exchangers, there are a plurality of units which are supported in a frame, and the concern and the problem is to snugly secure the units in a minimum of space but yet in a most secure manner and thereby avoid unnecessary vibration and possible consequent damage and noise and the like due to an unnecessary amount of clearance between the units. The prior art has utilized structural members extending along the sides of the heat exchanger units which are disposed in a frame to form the sectionalized heat exchanger. For example, see my U.S. Pat. No. 1,813,221 and U.S. Pat. No. 3,165,151.

Therefore, in the prior art sectional heat exchangers, there is a space or clearance between the units forming the exchanger and which are disposed in a frame. Where these heat exchangers are used in insulations creating vibrations, such as with an engine of perhaps two or three thousand horse power size, the exchanger itself is subjected to harmful vibrations and is therefore subject to failure. That is, where a large heat exchanger of the type involved in this invention is subjected to vibrations, the metal in the heat exchanger is subject to fatigue and fracture. Accordingly, it is a primary objective and advantage of this invention to improve upon the sectional heat exchangers of the prior art, such as those mentioned above.

Specifically, it is an object of this invention to provide a sectional heat exchanger wherein a plurality of units are mounted and fitted within an exchanger frame and the units are secured therein in a manner and by means which avoids vibration of the individual units and thus the reliability and life of the exchanger units is increased.

More specifically, it is an object and advantage of this invention to provide a sectional heat exchanger wherein the individual units can be slid or otherwise moved into the frame in their usual side-by-side relationship, and the assembly of the units within the frame, and the resulting strength of the entire exchanger, is an improvement over the exchangers of the prior art, and the assembly can be readily and easily accomplished and it does not require complicated and extensive fastening members or the like in order to accomplish the end result of overcoming or at least minimizing the vibration of the units, as mentioned above.

Still further, the present invention provides a heat exchanger with a plurality of units disposed within a frame and wherein the tolerances or spacings of the frame to the units and the units to each other is not extremely critical but, nevertheless, the units are fully secured and snugly disposed within the frame to avoid detrimental vibration and consequent failure of the units.

Other objects and advantages will become apparent upon reading the following description in light of the accompanying drawings.

DETAILED DESCRIPTION OF THE PREFERRED EMBODIMENT

Figure 1:
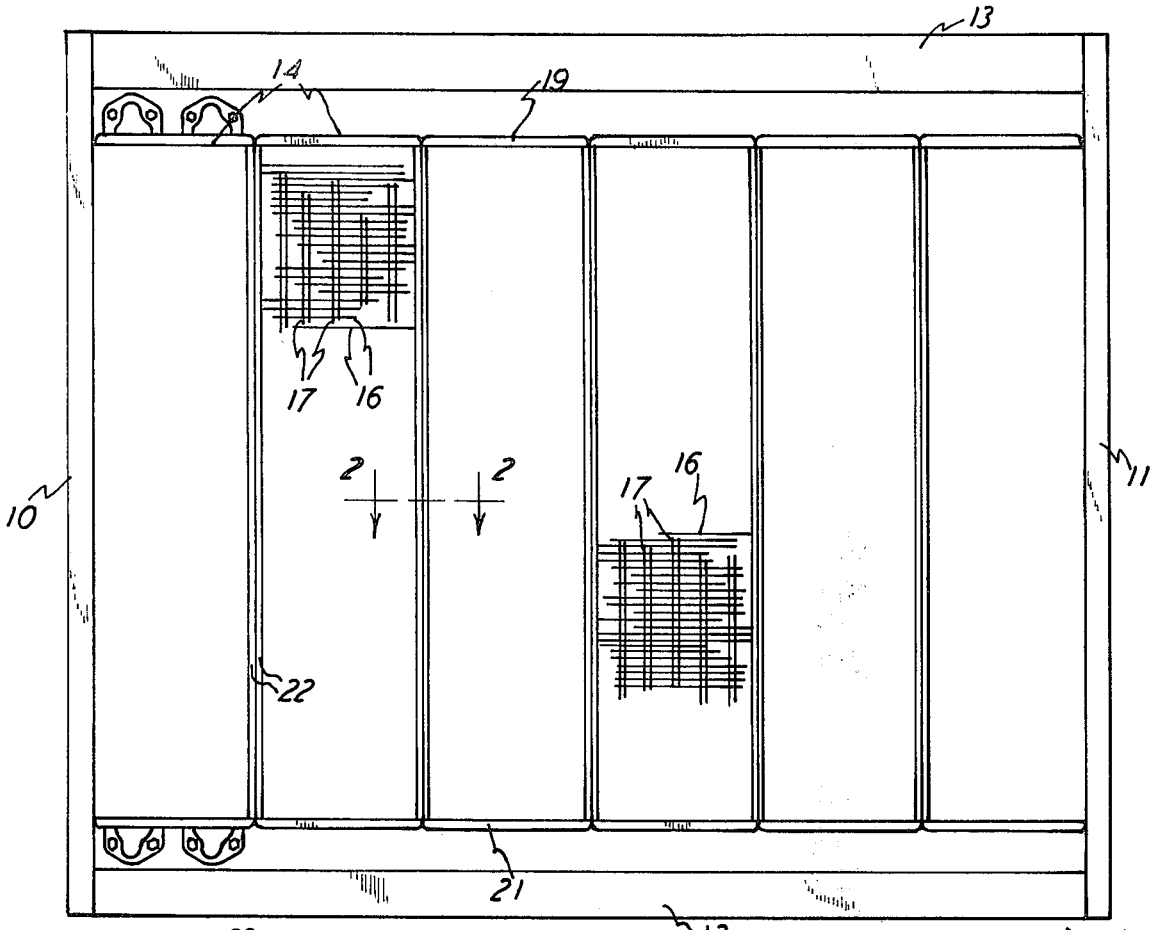
FIG. 1 is a front elevational view of a sectional heat exchanger made according to this invention.

FIG. 1 shows a sectional heat exchanger which has a frame consisting of the side members 10 and 11 and the bottom member 12 and the top member 13. The bottom and top members may also be the usual heat exchanger headers, and the members designated 10 through 13 form a rectangular frame for receiving the individual heat exchanger units designated 14. Thus, the view shows six of the units 14, but there can be any other number of units 14, and it will be understood by one skilled in the art that the entire sectional heat exchanger shown in FIG. 1 is formed by providing the individual heat exchanger units 14 and then sliding them into the frame members disclosed and then of course having the individual units 14 connected in fluid-flow communication with the headers 12 and 13, all in a conventional manner, and that is the manner in which they are shown in my U.S. Pat. No. 3,710,853, for instance, and as shown bolted in the leftward unit 14.

Of course the heat exchanger unit shown is therefore of the sectional type in that it includes a plurality of the units 14, and this type of exchanger is extremely large and may be as high as 6 feet and may be at least that wide, and it therefore has a large capacity for its cooling purpose, and it is commonly used in conjunction with an internal combustion engine which may develop vibrations at certain speeds, and the engine (which is not shown) would of course be fluid-flow connected with the heat exchanger shown in FIG. 1, for the usual purpose of cooling the engine coolant, and thus the heat exchanger is subjected to these vibrations. Therefore, with the units 14 solidly connected to the upper member 13 and the lower member 12, as mentioned and as is common in the art, then the individual units 14 are subjected to the vibration and are subject to metal fatigue and ultimate heat exchanger failure.

Figure 2:
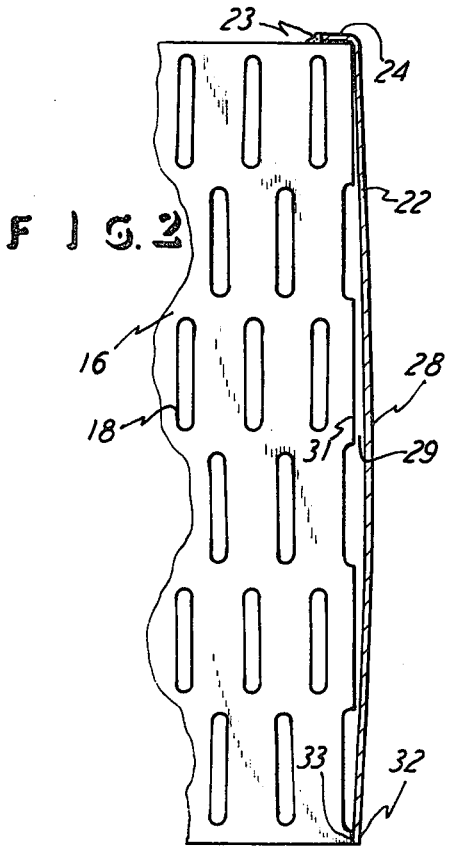
FIG. 2 is an enlarged view of a fragment of the exchanger of FIG. 1, and with the view being taken on the line 2—2 of FIG. 1.
Figure 4:
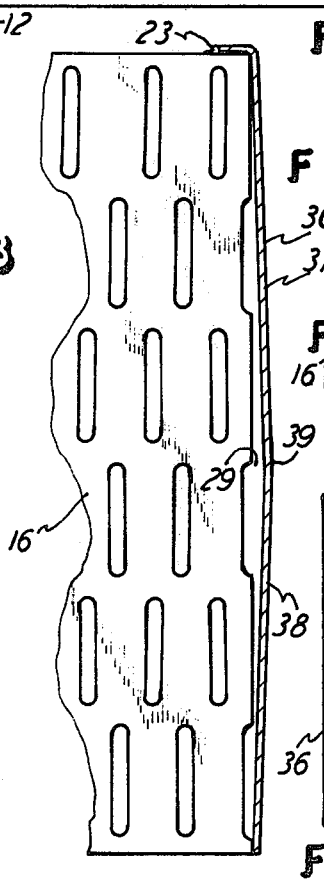
FIG. 4 is a sectional view similar to FIG. 2, but of another different embodiment of the side member.
Figure 6:
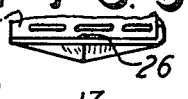
FIG. 6 is a top plan view of a fragment of the unit shown in FIG. 5.
Figure 5:
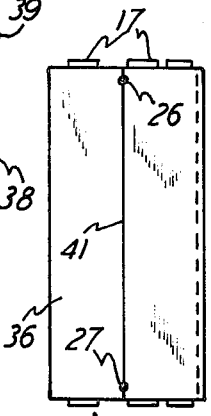
FIG. 5 is a side elevational view of an exchanger unit of FIG. 1, but on a reduced scale.

FIG. 1 further shows that the individual units 14 are of a conventional arrangement in that they include the usual metal fins 16 and the usual liquid conducting tubes 17 which extend through the fins 16, such as shown in U.S. Pat. No. 3,165,151, and in the conventional manner known in the art. FIGS. 2 and 4 show a fragment of one of the fins 16, and it will be seen that the fin 16 has elongated openings 18 extending therethrough, and these openings snugly receive the tubes 17 which extend for the length of each unit 14 and between header plates or the like 19 and 21 on each unit 14. FIGS. 5 and 6 also show the tubes 17.

With the exchanger as shown in FIG. 1, it will therefore be understood that the individual units 14 are slid or positioned into their locations in the sectional heat exchanger so that they are disposed in the side-by-side relationship shown in FIG. 1. The drawings further show that each unit 14 has a side plate 22 extending throughout the length and depth of each unit 14, as shown in FIGS. 5 and 6, for instance. The plates 22 are secured to the unit 14 by fusion bonding at the locations designated 23, and each plate 22 is shown to have an angulated end 24 which extends around the corners of the fins 16 and along the entire stack of fins 16 to be fusion bonded thereto, as mentioned. Also, each plate 22 may be attached to the fin units 14 by means of fusion bonding at the upper and lower ends of the plates 22 and on the centerline or portions thereof, as designated at upper and lower locations 26 and 27 in FIGS. 5 and 6. To actually accomplish the bondings at 26 and 27, the plate 22 may have a hole cut therein and then the plate would be disposed tightly against the adjacent one or ones of the fins 16 and bonding material would be applied thereto to result in the bonding indicated at locations 26 and 27.

Figure 3:
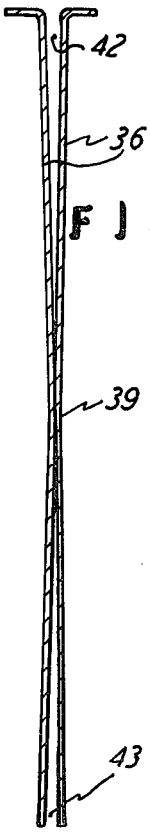
FIG. 3 is a sectional view showing two adjacent members of the exchanger units of FIG. 1, and with the view being similar to the portion shown in FIG. 2.

With the arrangement of the attachment of the plate 22 to the opposite sides of each unit 14, as mentioned above, and with the plate 22 being bowed or bent as shown in FIGS. 2 and 3 and 4, the plate 22 will have a high point or maximum offset point at the center thereof designated 28. The central portion 28 thus actually presents a clearance at 29 between the plate 22 and the adjacent edge 31 of the stack of fins 16 when the units 14 are not yet assembled in the final assembly of the sectional heat exchanger. Throughout this arrangement, the plate 22 is thus bent or bowed, as shown in the drawings, and the plate end 32 is in contact with the edge 33 of the stack of fins 16, as shown in FIGS. 2 and 4. FIG. 2 shows that the plate 22 has a continuous curve in its bend between its opposite ends 24 and 32, and that curve of course would have a center of curvature to the left of the plate 22, as viewed in FIG. 2, and that curvature would provide for the space 29, as described. It will also be noted that the bend of the plate in FIG. 4, and that plate is designated 34, is formed by two planar half-portions designated 37 and 38 which are joined at the centerline designated 39 which is spaced a maximum distance from the stack of fins 16 to again present the space 29. Thus, in the embodiment of FIG. 4, instead of the continuous curve of the plate, as with the plate 22, the plate 36 is formed by having a bend or fold or crease designated 41 and extending along the length of the plate 36, as seen in FIG. 5. Other than that difference, the plates 22 and 36 are the same and relate to the units 14 in the manner shown and described herein.

FIG. 3 therefore shows the positioning and relationship of two adjacent plates, such as the plates 36, when they are substantially in the position in the heat exchanger frame described. Thus, it will be seen that the plates central portions 39 are in abutment with each other, while the opposite sides or ends of the plates 39 are spaced apart somewhat, such as providing the spacings designated 42 and 43. Of course the amount of the spacings 42 and 43 will depend upon the final spacing between the total number of units 14 when they are disposed within the heat exchanger frame.

The plates 22 and 36 are made of a resilient and therefore yieldable metal material, such as a steel plate, and the two plate members present a crown at the center portion thereof, as described. Thus, when the units 14 are slid into the heat exchanger frame, the plate ends 24 readily permit the entrance of that end into the frame 14 so that the units can be slid either in contact with the frame pieces 10 or 11 or with the adjacent unit plate, depending upon the condition or assembly itself. While the units are being positioned and are in final assembled position, the plates 22 or 36 will compress or flex against each other and they may assume a final position as shown in FIG. 3 and thus the plates retain a yielding resilience between the units 14 and thereby snugly secure the units in the assembled position and thus overcome the damaging effects of vibration and the like. Of course in that arrangement, the plate ends 32 will be in contact with the fin ends or corners 33, though the ends 32 are not physically affixed to the fins 16, but the abutment of the plate ends 32 against the fin corners 33 will permit the breathing or adjustment of the plates 22 or 36 during assembly and after the units are assembled and the abutting contact will also secure the units and dampen the vibration, as desired. Accordingly, there is provided a side plate for a heat exchanger unit and with the plate being cambered and having a yieldability but being fastened in only certain locations so that it can be compressed or flattened out, as may be required but still be resilient and be yielding in the final assembly of the sectional heat exchanger. FIG. 3 shows the plates 36 with only a minimum of compressing therebetween; of course they can fully flatten, as indicated in FIG. 1, if the tolerances so permit, and that would be their preferred final position when flattened.

What is claimed is:

1. In a sectional heat exchanger having a plurality of separate heat exchanger units disposed in a frame which has opposite frame sides for receiving said units in side-by-side relation, and a plate extending between two of said units, the improvement comprising said plate being yieldingly compressible and affixed along one edge of said plate to one of said two units and with the edge of said plate opposite said one edge being free of attachment to said one unit, said yieldingly compressible plate being of a spring material and compressible between the two said units and having a central portion yieldingly urging toward the other of said two units for yieldingly urging said two units away from each other and respectively toward said frame sides and thereby snugly retain said units in said frame and lessen vibration of said units in said frame.

2. The sectional heat exchanger as claimed in claim 1, including two of said plates disposed between each two of said units with each said plate attached to each opposite side of a respective one of said units, and with said units disposed in a snug relation to have said plates in abutting contact with each other in the locations between said units.

3. The sectional heat exchanger as claimed in claim 2, wherein said central portions of said plates are offset from the plane along the peripheries of said plates, and with said central portions projecting away from said units on which said plates are attached.

4. The sectional heat exchanger as claimed in claim 3, wherein said plates are arcuately shaped to present their offset said central portions toward each other.

5. The sectional heat exchanger as claimed in claim 3, wherein said central portions of said plates are bent with a bend line therealong, and with the two portions on opposite sides of said bend line being planar and extending along flat planes.

* * * * *